US008561756B2

(12) United States Patent
Litovsky et al.

(10) Patent No.: US 8,561,756 B2
(45) Date of Patent: Oct. 22, 2013

(54) ACOUSTIC PORTS ALIGNED TO CREATE FREE CONVECTIVE AIRFLOW

(75) Inventors: Roman N. Litovsky, Newton, MA (US); Chester Smith Williams, Lexington, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 13/399,522

(22) Filed: Feb. 17, 2012

(65) Prior Publication Data

US 2013/0213730 A1 Aug. 22, 2013

(51) Int. Cl.
*A47B 81/06* (2006.01)

(52) U.S. Cl.
USPC ..... 181/198; 181/199

(58) Field of Classification Search
USPC ..... 181/198, 199
See application file for complete search history.

(56) References Cited

U.S. PATENT DOCUMENTS

| | | | | |
|---|---|---|---|---|
| 4,210,778 | A | 7/1980 | Sakurai et al. | |
| 4,379,951 | A | 4/1983 | Gabr | |
| 5,533,132 | A | 7/1996 | Button | |
| 5,792,999 | A | 8/1998 | Arnold et al. | |
| 6,259,798 | B1 | 7/2001 | Perkins et al. | |
| 6,430,300 | B1 * | 8/2002 | Cox et al. | 381/397 |
| 6,504,938 | B1 | 1/2003 | Anderson et al. | |
| 7,133,533 | B2 * | 11/2006 | Chick et al. | 381/349 |
| 7,202,577 | B2 | 4/2007 | Parison et al. | |
| 7,463,744 | B2 | 12/2008 | Parker et al. | |
| 8,107,662 | B2 * | 1/2012 | Parker | 381/345 |
| 2004/0017924 | A1 | 1/2004 | Kuratani et al. | |
| 2004/0195039 | A1 | 10/2004 | Sahyoun | |
| 2005/0094837 | A1 | 5/2005 | Parker et al. | |
| 2005/0111673 | A1 | 5/2005 | Rosen et al. | |
| 2005/0169494 | A1 * | 8/2005 | Stiles et al. | 381/337 |
| 2006/0039571 | A1 * | 2/2006 | Harris et al. | 381/87 |
| 2007/0092096 | A1 | 4/2007 | Litovsky | |
| 2007/0258612 | A1 * | 11/2007 | Mamin | 381/338 |
| 2009/0245561 | A1 | 10/2009 | Litovsky et al. | |
| 2010/0027815 | A1 | 2/2010 | Burge | |
| 2012/0051573 | A1 | 3/2012 | Litovsky et al. | |

FOREIGN PATENT DOCUMENTS

| | | | |
|---|---|---|---|
| EP | 0991295 | A2 | 4/2000 |
| JP | 63074297 | A | 4/1988 |
| JP | 2004274383 | A | 9/2004 |
| JP | 2005295334 | A | 10/2005 |
| JP | 2005295335 | A | 10/2005 |
| WO | 2008/064294 | A2 | 5/2008 |

OTHER PUBLICATIONS

International Search Report and Written Opinion dated Apr. 22, 2013 for PCT/US2013/026681.

* cited by examiner

*Primary Examiner* — Forrest M Phillips
(74) *Attorney, Agent, or Firm* — Bose Corporation

(57) ABSTRACT

Systems and methods to remove heat from an acoustic enclosure are provided. An apparatus includes an enclosure and a free convection passage located within the enclosure. The convection passage includes a non-horizontal convection inlet acoustic port having an inlet opening to the ambient environment and a non-horizontal convection outlet acoustic port having an outlet opening to the ambient environment. At least one heat producing element is coupled to an acoustic port of the free convection passage via a low thermal resistance conduction path. Heat produced by the heat producing element initiates a unidirectional free convective airflow in a direction corresponding to a path between the convection inlet acoustic port and the convection outlet acoustic port.

17 Claims, 3 Drawing Sheets

ACOUSTIC PORTS ALIGNED TO CREATE FREE CONVECTIVE AIRFLOW

I. FIELD OF THE DISCLOSURE

The disclosure relates to porting and heat removal in acoustic devices, and more particularly, to heat removal from ported acoustic enclosures.

II. BACKGROUND

To satisfy user demands for convenience and practicality, speaker systems are designed to be lighter and smaller. Smaller spacing requirements can present heat dissipation challenges. For example, an energized voice coil of an acoustic transducer generates heat that can reduce speaker performance and durability. While forced air convection devices are helpful in dissipating heat, fan components in such devices can consume additional power and space demands.

III. SUMMARY OF THE DISCLOSURE

According to a particular embodiment, an apparatus for reproducing acoustic signals includes an enclosure and a free convection passage located within the enclosure. The free convection passage includes a non-horizontal convection inlet acoustic port having an inlet opening coupled to the ambient environment. A non-horizontal convection outlet acoustic port has an outlet opening coupled to the ambient environment. The non-horizontal convection outlet acoustic port is positioned with its outlet opening to the ambient environment above the inlet opening to the ambient environment of the non-horizontal convection inlet acoustic port. At least one heat producing element is coupled to the free convection passage via a low thermal resistance conduction path. Heat produced by the heat producing element initiates a unidirectional free convective airflow in a direction corresponding to a path between the non-horizontal convection inlet acoustic port and the non-horizontal convection outlet acoustic port.

In another embodiment, a method of cooling an acoustic enclosure includes forming a free convection passage within an enclosure. The free convection passage includes a non-horizontal convection inlet acoustic port having an inlet opening coupled to the ambient environment and a non-horizontal convection outlet port having an outlet opening coupled to the ambient environment. The non-horizontal convection outlet port is positioned with its outlet opening to the ambient environment above the inlet opening to the ambient environment of the non-horizontal convection inlet acoustic port. The method further includes coupling at least one heat producing element to the free convection passage. Heat produced by the at least one heat producing element and is transferred to the free convection passage initiates a unidirectional convective airflow in a direction corresponding to a path between the non-horizontal convection inlet acoustic port and the non-horizontal convection outlet acoustic port.

A resultant unidirectional, free convective airflow in the free convection passage removes heat from an acoustic enclosure in the absence of speaker vibration. Temperature rise in the acoustic enclosure is reduced, and an embodiment of the apparatus has particular application in a speaker system having a relatively small size and high power generation, such as a satellite speaker system.

These and other advantages and features that characterize embodiments are set forth in the claims annexed hereto and forming a further part hereof. However, for a better understanding of the invention, and of the advantages and objectives attained through its use, reference should be made to the Drawings and to the accompanying descriptive matter in which there are described exemplary embodiments.

IV. BRIEF DESCRIPTION OF THE DRAWINGS

V. DETAILED DESCRIPTION

A particular embodiment includes multiple heat producing elements that are coupled to a free convection passage. An illustrative heat producing element includes an acoustic transducer in direct thermal contact with an acoustic port of the free convection passage. Illustrative direct thermal contact includes the presence of a low thermal resistance conduction path between the heat producing element and the acoustic port, such that the temperature drop across the conduction path is small. The heat producing element is physically attached to the free convection passage via at least one of heat sink material and a bracket. Thermal interface material such as thermal grease, a thermally conductive elastomeric pad, or other known interface materials may be incorporated in the junction between heat sink material and the bracket. Without loss of generality, thermal interface materials can be incorporated in the junction of any components of the thermal conduction path described herein, even if not specifically mentioned. In another embodiment, a portion of the heat producing element comprises a wall of the free convection passage. A resultant unidirectional, free convective airflow in the free convection passage removes heat from an acoustic enclosure in the absence of speaker diaphragm vibration.

Figure 1:
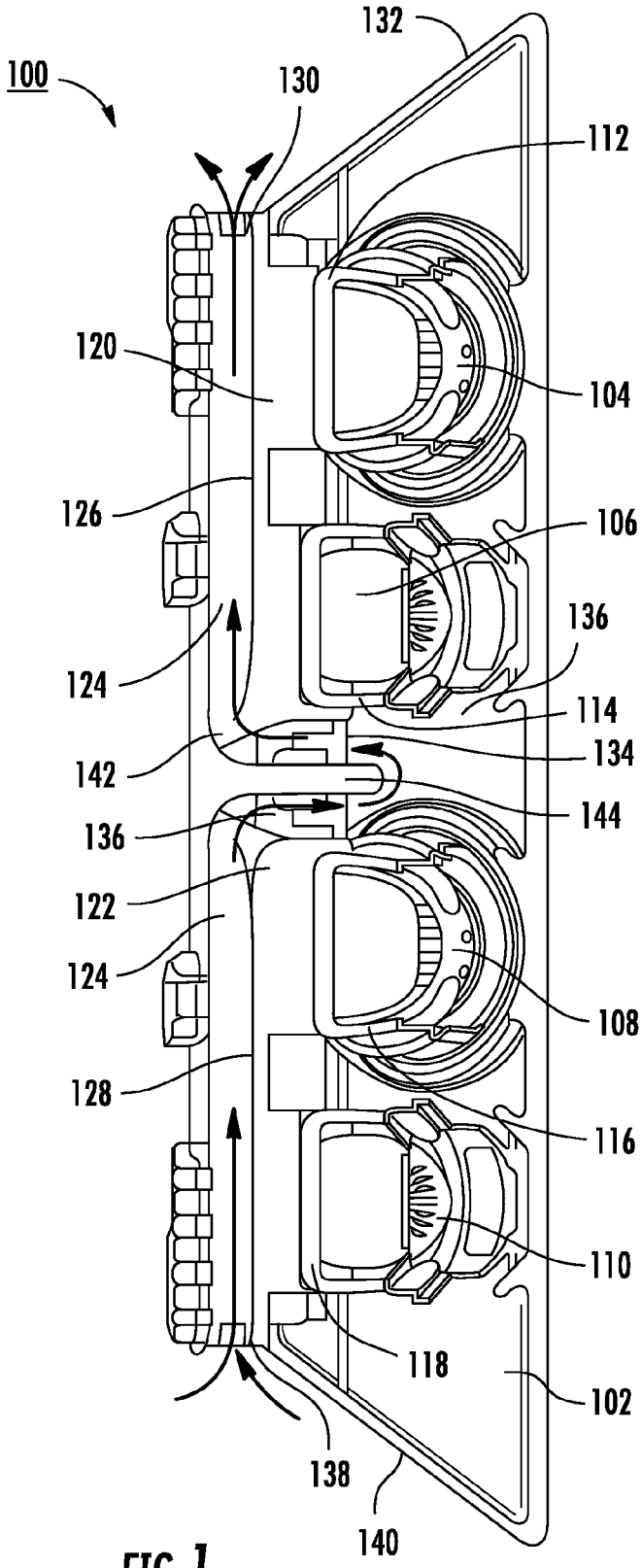
FIG. 1 is a cross-sectional perspective view of an embodiment of an apparatus that includes multiple acoustic transducers thermally coupled to a free convection passage that includes dual acoustic ports.

FIG. 1 is a perspective, cross-sectional view of an embodiment of an apparatus 100 that includes an enclosure 102 housing multiple acoustic transducers 104, 106, 108, 110. The acoustic transducers 104, 106, 108, 110 are thermally coupled to a free convection path 124. At least a portion of each of acoustic transducers 104, 106, 108, 110 is mechanically coupled to the free convection passage 124. The mechanical coupling also provides a heat conduction path to the free convection passage 124. As explained herein, the thermal coupling includes enabling heat generated by the acoustic transducers 104, 106, 108, 110 to be conducted to the free convection passage 124. The free convection passage 124 includes a first acoustic port 126 and a second acoustic port 128. The first and second acoustic ports 126 and 128 augment radiation of acoustic signals, in some embodiments in the frequency range of 200 Hz to 600 Hz, and in some embodiments in the range below 200 Hz. The acoustic transducers are heat sources, and heat generated within the transducers is conducted away to the free convection path for dissipation to the ambient environment. In some embodiments and as shown in FIG. 1, the transducers are thermally coupled to the outer surface of the inner facing wall of the free convection passage.

In some embodiments, the acoustic transducers 104, 106, 108, 110 are arranged in a substantially linear orientation and generate the radiating pressure waves. The transducers of other embodiments are arranged in different orientations to provide alternate radiation characteristics. The functioning of embodiments disclosed herein is not constrained by the particular orientation of transducers and use of different orientations for radiating sound waves from the transducers is contemplated herein. The walls of the free convection passage 124 are heated by the acoustic transducers 104, 106, 108, 110 to create a free convection airflow in the free convection passage 124 that removes heat from the enclosure 102.

Each acoustic transducer 104, 106, 108, 110 of an embodiment is mechanically coupled to a respective bracket 112, 114, 116, 118. The brackets 112, 114 are physically coupled to first heat sink material 120. The brackets 116, 118 are physically coupled to second heat sink material 122. The first heat sink material 120 and the second heat sink material 122 are in thermal contact with the free convection passage 124. The first and second heat sink material 120, 122 physically contact an outer surface of the free convection passage 124 or alternatively comprise a wall of the free convection passage 124. In general, a low thermal resistance path is formed between the heat sources and the free conductive path. Illustrative heat sources include the transducers 104, 106, 108, 110, and possibly other heat sources, such as heat producing elements of power amplifiers that are incorporated within the enclosure 102. Preferably, the free convection passage 124 incorporates sections that are not horizontal and that are vertical. Sections of other embodiments are angled with respect to vertical, and the heat sources are thermally coupled to the non-horizontally oriented sections of the free convection passage 124.

In some embodiments, the heat sink material 120, 122 and the brackets 112, 114, 116, 188 are integrally formed as a single component. The transducers 104, 106, 108, 110 of an embodiment are directly mechanically coupled to heat sink material 120, 122 without use of brackets 112, 114, by providing a slight interference fit between the heat sink material 120, 122 and the transducers 104, 106, 108, 110. For example, such mechanical coupling occurs when the transducers 104, 106, 108, 110 are assembled into the enclosure 102. According to another embodiment, the transducers 104, 106, 108, 110 are directly mechanically coupled to the free convection passage 124 by providing a slight interference fit between free convection passage and the transducers when the transducers are assembled into enclosure 102, without use of mechanical brackets 112, 114, 116, 188 and heat sink material 120, 122.

In some embodiments, the first acoustic port 126 is positioned in a substantially linear and vertical orientation with respect to the second acoustic port 128. For example, the first acoustic port 126 is positioned substantially above the second acoustic port 128 with respect to a base of the enclosure 102. The first acoustic port 126 has a first opening 130 near or at a top surface 132 of the enclosure 102 that opens to external, ambient air. A second opening 134 of the first acoustic port 126 opens to an interior portion 136 of the enclosure 102. The first acoustic port 126 additionally includes a curved or angled portion 142.

As heat is conducted from transducers 104, 106 into the acoustic port 126 (i.e., that forms part of the free convection passage 124), air within the acoustic port 126 is heated. The density of the heated air is reduced with respect to ambient air, which is at a lower temperature. The heated air rises due to the density difference, and the average direct current (DC) air pressure within the enclosure 102 will drop relative to ambient pressure. A source of inlet air is used to maintain free convective air flow. If only acoustic port 126 were present, a small amount of convection would occur until the DC pressure within the enclosure dropped to counteract the convective flow. Free convection would subsequently stop. Second acoustic port 128 acts as an air inlet to the enclosure to support continuous convective flow. The second acoustic port 128 provides an air inlet for cooler ambient air to flow into the enclosure 102 to replace the hot air the exits the enclosure 102 due to free convection.

The second opening 134 of the first acoustic port 126 receives a free convective airflow (indicated by bolded arrows) from a first opening 136 of the second acoustic port 128. A second opening 138 of the second acoustic port 128 opens to ambient air exterior to a bottom portion 140 of the enclosure 102. It is desirable, though not required, for the second opening 134 of the acoustic port 126 to be located above (with respect to the ground) the first opening 136 of port 128 when the enclosure 102 is oriented as intended in use (which in FIG. 1 is vertical). Locating the second opening 134 of the upper, acoustic port 126 above the first opening 136 of the second acoustic port 128 reduces the flow resistance of air in the path from second acoustic port 128 to the first acoustic port 126. The reduced flow resistance increases the air flow available in the free convection passage. A pressure drop due to flow resistance in the path within the enclosure will reduce the available pressure drop available to drive the convective flow.

One of the acoustic ports (e.g., acoustic port 126) acts as a convection exit from the enclosure, and the other acoustic port (e.g., acoustic port 128) acts as a convection inlet. The acoustic ports 126, 128 are oriented such that the direction of free convection flow within the convection inlet port is in the direction from the opening to the ambient environment into the enclosure 102. The direction of the free convection flow for the convection exit port is in a direction from the interior enclosure exit of the convection exit port towards the opening to the ambient environment of the convection exit port. In the embodiment of FIG. 1, this is accomplished by having the acoustic port 128 located with its opening to the ambient environment on the bottom of the enclosure 102. The acoustic port 126 is positioned with its opening to the ambient environment on the top of enclosure 102. In other words, the opening to the ambient environment of the acoustic port 126 forming the convection exit is above the opening of the ambient environment of the acoustic port 128 forming the convection inlet. For example, if both acoustic ports 126, 128 had heat sources attached and were oriented identically in the enclosure 102 (e.g., if both acoustic ports exited the enclosure 102 on the top and were oriented as port 126 is oriented), it would be no different than the single port described earlier, where a small amount of free convection would occur until the DC pressure within the enclosure 102 dropped sufficiently to cut off convection flow.

If only one of the pair of acoustic ports 126, 128 described in the above paragraph has heat sources attached, then free convection would be supported, though it would be less efficient than the arrangement of FIG. 1. In this case, it would be beneficial to configure the acoustic port with the heat sources thermally coupled as the convection outlet port. The port without heat sources would act as an air inlet port for free convection. For an embodiment where heat sources are only coupled to a single acoustic port, the acoustic port to which heat sources are coupled would preferably be oriented vertically, with its exit to the ambient environment located on the top of the enclosure 102. The second acoustic port without heat sources conductively coupled to it could be located with its opening to the ambient environment on any surface of the enclosure 102, but preferably would be oriented with its opening to the ambient environment on the bottom of the enclosure 102.

According to a particular embodiment, a partition 144 extends partially between the first acoustic port 126 and the second acoustic port 128. The partition 144 directs airflow into the interior of enclosure 102*m* which improves the transfer of heat from heated air within the enclosure to air flow in the free convective path.

In addition to facilitating free convective airflow, the first acoustic port 126 and the second acoustic port 128 are configured according to acoustic requirements. For example, the respective lengths and cross-sectional areas of the first and second acoustic ports 126, 128 are determined to provide a desired acoustic mass, to resonate with the compliance of the enclosure air volume at a desired resonance frequency. In a particular embodiment, it may be desirable to increase the cross-sectional area of the ports. In order to maintain a desired resonance frequency, the length of the ports would also have to be increased when the cross section area is increased, in order to maintain a desired port tuning frequency. Increasing the area and length of a port helps to reduce the maximum air velocities of the port air mass, which reduces acoustical losses. However, longer ports are more difficult to fit within a confined enclosure, and may need to bend or curve within the enclosure 102 in order to fit.

The free convection passage 124 uses free, or natural, convection transport. Free convective transport includes airflow created by density differences in the air that occur due to temperature gradients. The unidirectional free convection airflow flows without use of a forced convection source, such as a pump, a fan, or a suction device. Air in the free convection passage 124 receives heat from the interior walls of the free convection passage and become less dense. The warmed air consequently rises towards the first opening 130 at the top surface 132 of the enclosure 102. Surrounding, cooler air moves from the second opening 138 of the second acoustic port 128 to replace the warmer air. The resultant free convention airflow continues so long as heat is transferred to the free convection passage 124. As such, the free convective airflow continues after a heat producing element, such as the acoustic transducer 104, becomes inactive.

It is particularly beneficial to obtain the free convection path using elements that also function as acoustic ports. The operation of the acoustic system provides an alternating (AC) air flow, as air moves back and forth through the ports and interacts with air within the enclosure. The AC flow promotes efficient mixing of air within the enclosure. When this mixing is combined with the DC flow due to free convection, the efficient mixing of air within the enclosure with inlet air supporting convective flow improves overall heat removal from the system. It is desirable for the AC flow induced by driving the resonance of the port acoustic mass with the enclosure compliance to mix with air in the region around the heat sources within the enclosure, and with air located towards the top of the enclosure. Increasing air flow over heat sources increases the heat removal from the sources. Since hot air rises within the enclosure, promoting mixing of port air with box air in the region where hot air is located also improves heat removal from the system.

The first and second heat sink material 120, 122 of an embodiment includes a thermal interface material having a low thermal resistance. Examples of thermally conductive materials include thermal grease and thermally conductive elastomers. The heat sink material of an embodiment includes a metal pad (not shown) that abuts a backside (e.g., a transducer cup) of an acoustic transducer when a speaker is assembled.

An embodiment has particular application in a speaker system having a relatively small size and high power generation, such as in a satellite speaker system. Moreover, the DC, free convective airflow in the free convection passage 124 removes heat from an acoustic enclosure in the absence of speaker diaphragm vibration. For example, a speaker component that has been deactivated, but that is still hot, communicates thermal energy to the acoustic port arrangement to generate the free convective airflow.

FIG. 1 thus shows an apparatus 100 that facilitates heat removal from an enclosure 102 using a free convection passage 124 that includes dual acoustic ports 126, 128. Either one or both of the dual acoustic ports 126, 128 are coupled to heat producing elements, such as the acoustic transducers 104, 106, 108, 110 and amplifiers, either directly or via a low thermal resistance material. Thermal interface material may be located at interfaces between different structures or parts located in the thermal path from heat source to acoustic ports. The partition 144 positioned between the acoustic ports 126, 128 deflects air moving in the acoustic ports to promote heat transfer. In addition to facilitating free convective airflow, the first and the second acoustic ports 126,128 are configured to produce a desired acoustical output.

Figure 2:
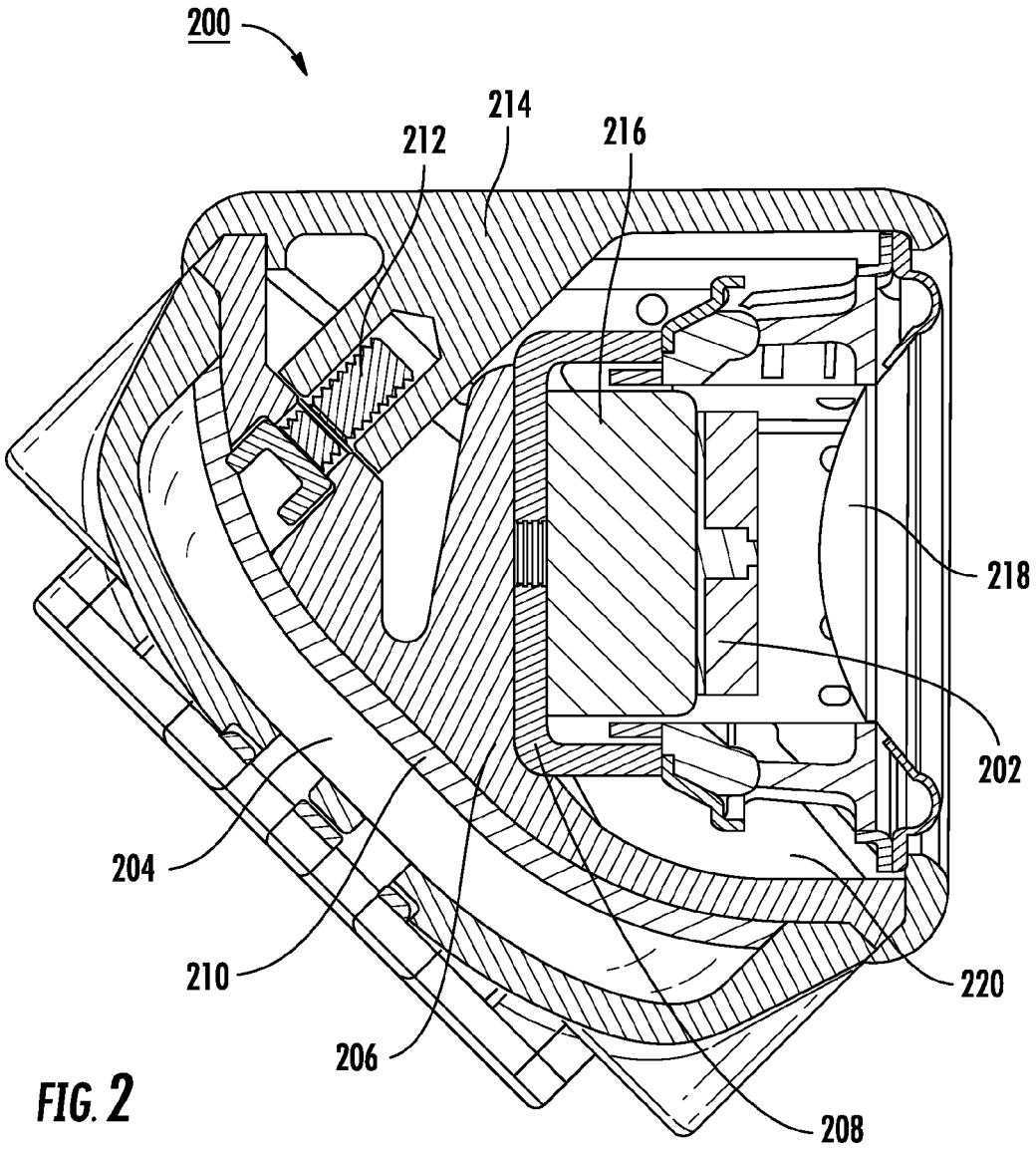
FIG. 2 is a top view, cross-sectional perspective of an embodiment of an apparatus including an acoustic transducer that is thermally coupled to a free convection passage via heat sink material.

FIG. 2 shows a top view, cross-sectional perspective of an embodiment of an apparatus 200 that includes an acoustic transducer 202 that is thermally coupled to a free convection passage 204 via heat sink material 206. The acoustic transducer 202 may be one of multiple transducers, such as the acoustic transducer 104 comprising part of the system 100 of FIG. 1. As shown, a transducer cup 208 of the acoustic transducer 202 is in direct physical contact with the heat sink material 206. Though not shown, thermal interface materials may be used to interface between different elements of the assembly, to reduce the thermal resistance of interfaces between components.

The transducer cup 208 becomes hot when the acoustic transducer 202 is active. More particularly, a current is applied to a motor structure 216 of the acoustic transducer 202 to cause an acoustic driver cone 218 to vibrate and radiate sound waves. In driving the acoustic driver cone 218, the motor structure 216 dissipates some of the electrical input power as heat that is transferred to the transducer cup 208. The heat is radiated into an interior 220 of the enclosure 214.

The heat sink material 206 is in direct physical and thermal contact with a wall 210 of the free convection passage 204. Though not shown, thermal interface materials may be used to interface between the heat sink and the wall, to reduce the thermal resistance of the interface. A fastener 212 secures an enclosure 214 and the acoustic transducer 202 to one or more of the heat sink material 206 and the free convection passage 204 in order to establish a low thermal resistance thermally conductive path.

The enclosure 214 of an embodiment can be constructed of a thermally conductive material, such as aluminum, copper, steel, and the like. Thermal coupling of the heat sink material 206 to the enclosure 214 when formed from a thermally conductive material improves heat dissipation, as the walls of the enclosure 214 dissipate heat to the ambient environment.

In some embodiments, the heat sink material 206 is forced against the transducer cup 208. Increasing the pressure of an interface between materials reduces the thermal resistance of the interface in a desirable manner. The acoustic transducer 202 is located in one portion of the enclosure 214, and the heat sink material 206 and the acoustic port are located in another portion of the enclosure 214. The fastener 212 pulls the two portions of the enclosure 214 together and applies pressure at the interface between the transducer cup 208 and the heat sink material 206.

A draft effect is created in the free convection passage 204 as the temperature within rises. The resultant free convection airflow transfers heat away from the motor structure 216 through the free convection passage 204, thereby cooling the acoustic transducer 202 and the enclosure 214. Additionally, sound waves radiated into the interior 220 of the enclosure 214 by the acoustic driver cone 218 cause the acoustic mass of ports 126, 128 to resonate with the compliance of the air in the enclosure, which promotes efficient mixing of external air with air in the enclosure. The effect of the mixing is to further improve the heat transfer out of the enclosure.

FIG. 2 thus shows a heat producing element thermally coupled with a substantially vertically oriented free convection passage 204. The heat coupled into the free convection passage drives the convective air flow. The free convective airflow of the free convection passage 204 can continue in the absence of port AC air motion caused by motion of the acoustic transducer diaphragms, as long as heat is provided to the free convection passage from heat sources in the enclosure. There can be an absence of port AC flow if, for example, the signals applied to the transducers do not contain any energy in the frequency range of the port resonance, or if signals to a transducer are shut off for a period of time. While a heat producing element of FIG. 2 includes the motor structure 216 of the acoustic transducer 202, other illustrative heat producing elements include an optional heat producing device, such as a power supply or an amplifier for a loudspeaker.

Figure 3:
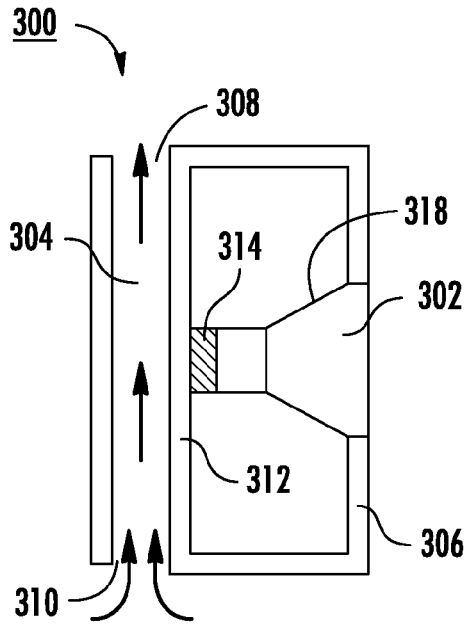
FIG. 3 is a cross-sectional view of an embodiment of an apparatus that includes an acoustic transducer that is thermally coupled to an acoustic port.

FIG. 3 illustrates an embodiment of an apparatus 300 that includes a heat source, such as an acoustic transducer 302. The acoustic transducer 302 is located in an enclosure 306 with one surface of a diaphragm 318 of the acoustic transducer 302 facing into enclosure 306 and the opposite side of the diaphragm 318 facing the ambient environment. A free convection passage 304 is located adjacent the enclosure 306. At least a portion of a wall of the enclosure 306 forms at least a portion of a wall of the free convection passage 304. Preferably, the portion of the wall of enclosure 306 that is coupled to the acoustic transducer 302 via the low thermal resistance conductive path is formed of a low thermal resistance material, such as aluminum, copper or other metal or thermally conductive polymer.

The free convection passage 304 includes a first opening 308 and a second opening 310. The first opening 308 is positioned in a substantially linear orientation with respect to the second opening 310. For example, the first opening 308 is arranged substantially above the second opening 310. Heat sink material 314 is positioned between the acoustic transducer 302 and a wall 312 of the free convection path 304. Thought not shown, thermal interface material may be placed between the heat sink material 314 and the acoustic transducer 302, and between the heat sink material 314 and the wall 312.

A low thermal resistance thermal conduction path is formed between the acoustic transducer 302 and the wall or portion thereof of the enclosure 306 that forms a wall or portion thereof of the free convection path 304. Heat conducted from the acoustic transducer 302 to the free convection path 304 through the low thermal resistance heat conduction path initiates a unidirectional free convective airflow in a direction (indicated by the arrows) from the second opening 310 to the first opening 308. The first opening 308 allows the escape of heated air near a top portion of the enclosure 306, and the second opening 310 intakes cooler ambient air near a bottom portion of the enclosure 306. The free convective airflow transfers heat away from the acoustic transducer 302 through the first opening 308, thereby cooling both the acoustic transducer 302 and the enclosure 306.

Figure 4:
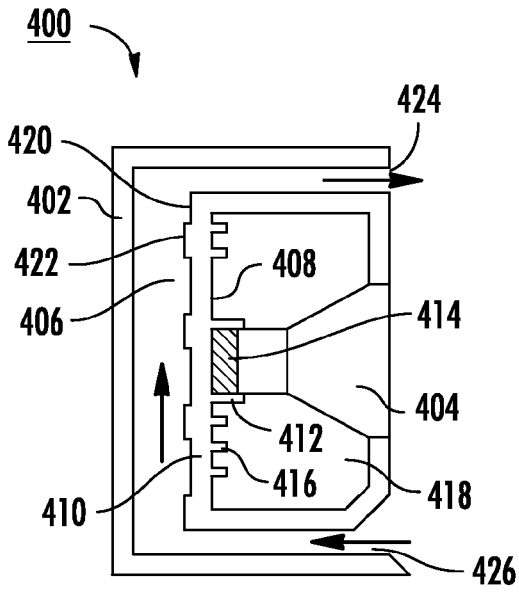
FIG. 4 is a cross-sectional view of an embodiment of an apparatus that includes an acoustic transducer thermally coupled to a free convection passage having a bracket, an extrusion vein, and a fin structure.

FIG. 4 illustrates a cross-sectional view of an embodiment of an apparatus 400 that includes an enclosure 402 housing an acoustic transducer 404. The acoustic transducer 404 is thermally coupled to a free convection passage 406. An exterior surface 408 of a wall 410 of the free convection passage 406 includes a bracket extension 412 that physically couples directly to at least one of the acoustic transducer 404 and heat sink material 414. The heat sink material 414 is positioned in direct contact with the acoustic transducer 404. Though not shown, thermal interface materials can be placed in the junctions between various structures described above. A low thermal resistance heat conduction path is formed between the acoustic transducer 404 and the free convection passage 406.

The exterior surface 408 of the wall 410 includes extensions 416, such as heat fins, configured to draw heat from an interior portion 418 of the enclosure 402 to the wall 410 of the free convection passage 406. The extensions 416 increase the surface area of the exterior surface 408 of wall 410 that is exposed to the interior air volume of enclosure 402. The wall 410 is preferably formed from a thermally conductive material, such as aluminum, copper, or other metal, or a thermally conductive polymer material. The wall 410 and the extensions 416 provide a second path (e.g., in addition to a conduction path through mechanical structure) from a heat source to air inside the free convection passage 406 to further reduce the ambient temperature within the enclosure 406.

In some embodiments, an interior surface 420 of the wall 410 of the free convection passage 406 includes protruding elements 422. The protruding elements 422 are configured to increase the surface area of wall 410 exposed to the free convective air flow, to increase heat transfer from the wall 410 and into the free convection passage 406. The protruding elements 422 include metallic structures that extend from the interior surface 420 into the free convection passage 406. The protruding elements 422 are preferably vertically oriented fins that extend over a large portion of surface 420. An embodiment of the protruding elements 422 provides increased surface area with small cross-section area relative to the vertical airflow. As such, there is relatively little obstruction of the convective flow. An embodiment of the protruding elements 422 extends across most or all of the free convection passage 406. Increasing the surface area reduces the overall thermal resistance from the heat source to air in the free convection passage 406. Another embodiment includes protruding elements in the acoustic ports. The dimensions of the ports are modified to reduce turbulence and audible noise. For example, the cross-sectional areas and lengths of the acoustic ports are increased to keep tuning constant while reducing port air velocity, which in turn reduces turbulence.

The free convection passage 406 includes a first opening 424 and a second opening 426. Heat communicated by the acoustic transducer 404 to the free convection passage 406 initiates a unidirectional free convective airflow from the first opening 424 to the second opening 426. As shown in FIG. 4, the second opening 426 is tapered. More particularly, the second opening 426 is flared outwardly. The tapering of the second opening 426, as with all openings of an embodiment, supports and augments the free convective DC airflow.

Those skilled in the art may make numerous uses and modifications of and departures from the specific apparatus and techniques disclosed herein without departing from the inventive concepts. Consequently, the disclosed embodiments should be construed as embracing each and every novel feature and novel combination of features present in or possessed by the apparatus and techniques disclosed herein and limited only by the scope of the appended claims, and equivalents thereof.

The invention claimed is:

1. An apparatus for reproducing acoustic signals, the apparatus comprising:

an enclosure;

a free convection passage located within the enclosure, the free convection passage comprising:

a non-horizontal convection inlet acoustic port having an inlet opening coupled to the ambient environment and an outlet opening coupled to an internal volume of the enclosure; and a non-horizontal convection outlet acoustic port having an outlet opening coupled to the ambient environment and an inlet opening coupled to the internal volume of the enclosure, wherein the non-horizontal convection outlet acoustic port is positioned with its outlet opening to the ambient environment above the inlet opening to the ambient environment of the non-horizontal convection inlet acoustic port; and at least one heat producing element coupled to the free convection passage via a low thermal resistance conduction path, wherein heat produced by the heat producing element initiates a unidirectional free convective airflow in a direction corresponding to a path between the non-horizontal convection inlet acoustic port and the non-horizontal convection outlet acoustic port.

2. The apparatus of claim 1, wherein the enclosure includes a top portion and a bottom portion, and wherein the non-horizontal convection outlet acoustic port is positioned substantially at the top portion, and the non-horizontal convection inlet acoustic port is positioned substantially at the bottom portion.

3. The apparatus of claim 1, wherein the at least one heat producing element is in direct thermal contact with the free convection passage.

4. The apparatus of claim 1, further comprising a bracket directly contacting the at least one heat producing element, wherein the bracket is in thermal communication with the free convection passage.

5. The apparatus of claim 4, wherein the bracket comprises a portion of an outer surface of an inner facing wall of the free convection passage.

6. The apparatus of claim 1, wherein the at least one heat producing element includes at least one of: an acoustic transducer, a power supply, a loudspeaker, and an amplifier.

7. The apparatus of claim 1, wherein the at least one heat producing element is one of a plurality of heat producing elements positioned in a substantially non-horizontal relationship with respect to one another and in thermal communication with the free convection passage.

8. The apparatus of claim 1, wherein the free convection passage includes an inner facing wall having an outer surface comprising heat fins to collect heat from inside the enclosure.

9. The apparatus of claim 1, wherein the free convection passage includes an inner surface comprising an extrusion vein structure.

10. The apparatus of claim 1, wherein at least one of the non-horizontal convection inlet acoustic port and the non-horizontal convection outlet acoustic port is metal.

11. The apparatus of claim 1, wherein at least one of the non-horizontal convection inlet acoustic port and the non-horizontal convection outlet acoustic port is tapered.

12. The apparatus of claim 1, wherein at least one of the non-horizontal convection inlet acoustic port and the non-horizontal convection outlet acoustic port includes at least one of an angled portion and a curved portion.

13. The apparatus of claim 1, further comprising a partition positioned between the non-horizontal convection inlet acoustic port and the non-horizontal convection outlet acoustic port.

14. The apparatus of claim 1, further comprising at least one of heat sink material and a thermally conductive interface material positioned between the free convection passage and the at least one heat producing element.

15. A method of cooling an acoustic enclosure, the method comprising:

forming a free convection passage within an enclosure, the free convection passage including:

a non-horizontal convection inlet acoustic port having an inlet opening coupled to the ambient environment and an outlet opening coupled to an internal volume of the enclosure; and a non-horizontal convection outlet port having an outlet opening coupled to the ambient environment and an inlet opening coupled to the internal volume of the enclosure, wherein the non-horizontal convection outlet port positioned with its outlet opening to the ambient environment above the inlet opening to the ambient environment of the non-horizontal convection inlet acoustic port; and coupling at least one heat producing element to the free convection passage, wherein heat produced by the at least one heat producing element and transferred to the free convection passage initiates a unidirectional convective airflow in a direction corresponding to a path between the non-horizontal convection inlet acoustic port and the non-horizontal convection outlet acoustic port.

16. The method of claim 15, further comprising coupling the free convection passage to a bracket in contact with the at least one heat producing element.

17. The method of claim 15, further comprising positioning at least one of heat sink material and a thermally conductive interface material between the free convection passage and the at least one heat producing element.

* * * * *